US006278032B1

(12) United States Patent
Falchi

(10) Patent No.: US 6,278,032 B1
(45) Date of Patent: Aug. 21, 2001

(54) ETHYLENE POLYMERS WITH α-OLEFINS

(75) Inventor: Paolo Falchi, Milan (IT)

(73) Assignee: Societa' Italiana Additivi per Carburanti S.r.l., Pescara (IT)

( * ) Notice: Subject to any disclaimer, the term of this patent is extended or adjusted under 35 U.S.C. 154(b) by 0 days.

(21) Appl. No.: 09/328,881

(22) Filed: Jun. 9, 1999

(30) Foreign Application Priority Data

Jun. 11, 1998 (IT) ..... MI98A1325

(51) Int. Cl.[7] ..... C08F 210/16; C10L 1/16

(52) U.S. Cl. ..... 585/12; 585/14; 44/314; 44/317

(58) Field of Search ..... 585/12, 14; 44/314, 44/317

(56) References Cited

U.S. PATENT DOCUMENTS

| | | |
|---|---|---|
| 3,661,541 | 5/1972 | Hollyday, Jr. . |
| 4,211,534 | 7/1980 | Feldman . |
| 5,097,084 | 3/1992 | Milani et al. . |

FOREIGN PATENT DOCUMENTS

| | | |
|---|---|---|
| 0 153 176 B1 | 8/1985 | (EP) . |
| 0 153 177 B1 | 8/1985 | (EP) . |
| 0350072 | 1/1990 | (EP) . |
| 0572034 | 12/1993 | (EP) . |
| 0 811628 | 12/1997 | (EP) . |
| 0848020 | 6/1998 | (EP) . |
| WO 93/08221 | 4/1983 | (WO) . |
| WO 91/11488 | 8/1991 | (WO) . |
| 94/13718 | 6/1994 | (WO) . |
| 0 612768 | 8/1994 | (WO) . |
| 0 612769 | 8/1994 | (WO) . |
| 0 743324 | 11/1996 | (WO) . |
| 0 776908 | 6/1997 | (WO) . |

OTHER PUBLICATIONS

J.C. Randall, "Methylene Sequence Distributions and Number Average Sequence Lengths in Ethylene–Propylene Copolymers", *American Chemical Society*, vol. 11, No. 1, Jan.–Feb., 1978, pp. 33–36.

J.A. Ewen, "Metallocene/Polypropylene Structural Relationships: Implications on Polymerization and Sterochemical Control Mechanisms", *Makromol. Chem. Sym.*, 48/49, pp. 253–295, 1991, month unavailable.

*Primary Examiner*—Jacqueline V. Howard
(74) *Attorney, Agent, or Firm*—Arent Fox Plotkin Kintner Kahn PLLC.

(57) ABSTRACT

Ethylene copolymers with octene and/or ethylene terpolymers with alpha-olefins from 3 to 12 carbon atoms, optionally in the presence of other comonomers containing more than one unsaturation, usable as additives to increase the gas oil properties at low temperatures, obtainable by polymerization of the monomers in the presence of catalysts comprising:

a bis-cyclopentadienyl derivative having the general formula:

$$(Cp_1Cp_2)—M—(L_2L_3)$$

containing groups with oxygen bound to the transition metal, wherein

M is a metal from the IIIb group to the Vb group or of the lanthanide series of the Element Periodic Table;

$Cp_1$ and $Cp_2$, equal to or different from each other, represent cyclopentadienyls bound to M with delocalized π bonds.

14 Claims, No Drawings

ETHYLENE POLYMERS WITH α-OLEFINS

The present invention relates to liquid hydrocarbon compositions, for instance gas oils, generally known as middle distillates.

It is well known that the middle distillates contain alkanes which at low temperatures tend to precipitate under the form of waxes as high size crystals. In this way gel structures are formed which cause the middle distillate fluidity loss. Therefore there are problems of storage, transfer and feeding of the middle distillates through pipes, pumps and moreover obstruction phenomena of the line filters and of those of the propulsors feeding lines occur.

These problems are well known in the art and for the cold behaviour definition, the middle distillates are characterized from the physical point of view by the following features determined according to various standard methods: Cloud Point (C.P.), Pour Point (P.P.), Cold Filter Plugging Point (C.F.P.P.), Wax Antisettling (W.A.S.) etc.

Various additives, some of them in the market, having selective and/or multifunctional uses are known in the art, able to improve the above mentioned middle distillate cold propoerties. The additives generally have the purpose to modify the wax crystals formed at low temperatures both reducing the size and modifying the form thereof.

Indeed the crystals having reduced size give less problems of filter clogging. A further property required to additives is that to maintain in suspension the formed crystals, that is to obtain the result to have a reduced settling rate. Also this effect prevents the filter clogging at low temperatures, particularly it reduces wax accumulations on the tank bottom during storage of middle distillates in the refinery.

The additives known in the art to overcome such disadvantages are generally polymeric products of various types.

See for example Patent Application WO 91/11488 which claims the combination of some of the above mentioned additives with ethylene (co)polymers with alpha-olefins, specifically ethylene/propylene copolymers obtainable by polymerization of ethylene with alpha-olefins in the presence of catalysts based on a)

coordination organometallic compounds which are cyclopentadienyl derivatives of a transition metal of the Group 4b of the Periodic Table and comprise mono-, di- and tri-cyclopentadienyl and their derivatives of the transition metal, with b)

alumoxanes, which are the reaction products of trialkyl aluminum with water.

The obtained ethylene/alpha-olefin copolymers have the essential feature to have at least 30% of the polymeric chains with ending ethenylidene or ethylene unsaturations. These copolymers can be combined with one or more additives known in the art having the property to improve the middle distillate characteristics at low temperatures.

Ethylene/alpha-olefin (co)polymers used for the same purpose are also known in the art, see U.S. Pat. No. 5,097,084. They are characterized by the substantial absence of propylene linking inversions as shown by the $X_2$ and/or $X_4$ parameters lower than or equal to about 0.02, determined by $^{13}C$ NMR according to the method described by J. C. Randal in "Macromolecules" 11, 33 (1978). The ethylene/propylene copolymers having said values of the mentioned parameters clearly show better CFPP values than the copolymers in which said values are not satisfied, for instance the vanadium-based catalysts.

Ethylene or alpha-olefin copolymers, or unsaturated esters, for instance vinylacetates, with maleic or fumaric acid, or unsaturated monocarboxylic acid esters, for instance acrylates, are also known in the art. Ethylene/vinylacetate (EVA) copolymers, fumarates, propionates, etc., can be mentioned. See for instance U.S. Pat. No. 3,661,541, U.S. Pat. No. 4,211,534, EP 153,176, EP 153,177. Various combinations of the described copolymers are indicated too in these Patents, optionally in combination with a nitrogen polar compound.

It has been surprisingly and unexpectedly found by the Applicant that specific copolymers of ethylene with octene and/or terpolymers of ethylene, octene with at least an alpha-olefin show improved properties when are used as additives to improve the middle distillate physical behaviour at low temperatures. In particular the invention polymers show improved C.F.P.P values.

It is an object of the present invention copolymers of ethylene with octene and/or terpolymers of ethylene, octene with at least an alpha-olefin having from 3 to 12 carbon atoms, optionally in the presence of other comonomers containing more than one ethylenic unsaturation, usable as additives to improve the middle distillate properties at low temperatures, obtainable by polymerization of the monomers in the presence of catalysts comprising the reaction product among:

1) a bis-cyclopentadienyl derivative of general formula:

$$(Cp_1Cp_2)—M—L_2L_3)$$

containing groups with oxygen bound to the transition metal, wherein

M is a metal from the group IIIb to the group Vb or of the lanthanide series of the Element Periodic Table; $Cp_1$ and $Cp_2$ equal to or different from each other represent the following groups bound to M with delocalized π bonds, in particular with an eta 5 bond when the groups are selected from cyclopentadiene, indene, fluorene, or derivatives thereof substituted in the case of indene and fluorene also with the hydrogenated phenyl ring (rings) and with substituents both in phenyl and cyclopentadienyl rings, also with heteroatoms; or with π bonds for example in the case of cyclooctatriene; or said $Cp_1$ $Cp_2$ groups constrained with M by a bivalent linking bridge, for example —R— type, wherein R is an alkylene, preferably from 1 to 4 carbon atoms, $—Si(R')_2—$ wherein R' is an alkyl from 1 to 10 C atoms, preferably from 1 to 6 carbon atoms; or an aryl optionally containing heteroatoms, such as O, N, or alkylaryl or arylalkyl from 7 to 20 carbon atoms;

$L_2$ and $L_3$ equal to or different from each other represent a group $OR_a$ wherein $R_a$ is an aryl group, optionally the ring carbon atoms being substituted also by heteroatoms, and optionally containing substituents for example of alkyl type from 1 to 10 carbon atoms with 2) a cocatalyst selected from the compounds represented by the following formulas:

2a) alumoxane, having the general formula:

$$(R_b—Al—O)_m,$$

in the form of cyclic compound or in the form of linear polymeric compound of formula $$R_b(R_b—Al—O)_mAl(R_b)_2;$$

alumoxane is generally a mixture of the two mentioned forms;

$R_b$ is an alkyl group from 1 to 5 C atoms, preferably methyl, m is an integer from 1 to 30, preferably from 4 to 20;

m' is an integer from 3 to 20, preferably from 4 to 20;

2b) $(L_1—H)+(A)^-$ wherein (A) is a compatible non coordinating anion, preferably $$(B\ Q_q)^-$$

wherein $L_1$ is a neutral Lewis basis, $(L_1—H)^+$is a Bronsted acid,

B is an element of the group from IIIa up to VIa of the Element Periodic Table with metalloidic characteristics, preferably boron, phosphorus or arsenic with valence 3 or 5, silicon, more preferably boron with valence 3;

Q, equal to or different from each other, are selected from the following groups: hydrides, halides, alkyls, aryls optionally substituted, for example with halogens, preferably F, alkoxides, aryloxides, dialkylamido, or $R_0COO$— wherein $R_0$ ranges from 1 to 20 carbon atoms, with the proviso that Q can be equal to halide only once, q is an integer equal to the valence of B plus 1.

The preferred co-catalyst component 2) is 2b).

The alumoxane compound 2a) of the catalytic system is preferably prepared by reaction of trimethyl aluminum and water, obtaining a mixture of linear and cyclic compounds. They are generally prepared by putting into contact a solution of trialkyl aluminum with water in suitable organic solvents, for instance aliphatic hydrocarbons.

As known, alumoxanes are compounds containing Al—O—Al bonds, having a variable O/Al molar ratio, obtainable in the art by reaction, under controlled conditions, of an alkyl aluminum, or an alkyl aluminum halide, with water and, in the case of trimethyl aluminum, also with an hydrate salt, such as hexahydrate aluminum sulphate, pentahydrate copper sulphate and pentahydrate iron sulphate.

The molar ratio between Al of the component 2a) alumoxane with respect to the amount of the metal of component 1 (metallocene) is in the range 10,000:1–100:1, preferably 5,000:1–500:1. In the case of compound 2b) the ratio ranges from (0.1–4):1 and preferably from (0.5–2.0):1.

Preferred examples of the compound 2b) have the general formula $$(L_1—H)^+(B\ Q_4)^-$$

wherein the $L_1$ and Q meanings are above indicated, B is the boron with valence 3. $L_1$ can be $NH_3$, aniline, pyridine, quinoline, alkylamines, dialkylamines, trialkylamines with the alkyl from 1 to 8 C atoms, preferably from 1 to 4, phenylamines, etc. All these compounds can, respectively, form quaternary ammonium salts, pyridinium salts, quinolinium salts, which represent, $(L_1—H)^+$. Exemplifying compounds which can be mentioned are the following:

substituted ammonium trialkyl salts, for example triethylammonium tetraphenylborate, tripropylammonium tetraphenylborate, tris (n-butyl) ammonium tetraphenylborate, trimethylammonium tetrakis(p-tolyl) borate, tributylammonium tetrakis(pentafluorophenyl) borate, tripropylammonium tetrakis (2,4-dimethylphenyl) borate, tributylammonium tetrakis(3,5-dimethylphenyl) borate, triethylammonium tetrakis (3,5-ditrifluoromethylphenyl)borate etc.

The N,N-dialkyl anilinium salts can also be used, such as for example N,N-dimethyl anilinium tetraphenylborate, N,N-diethyl anilinium tetraphenylborate, N,N-2,4,6-pentamethylanilinium tetraphenylborate etc.; dialkyl ammonium salts such as di-(i-propyl)ammoniumtetrakis (pentafluorophenyl)borate, dicyclohexylammonium tetraphenylborate etc.; triaryl phosphonium salts such as triphenylphosphonium tetraphenylborate, tri(methylphenyl) phosphonium tetrakis pentafluorophenylborate, tri (dimethylphenyl) phosphonium tetraphenylborate etc.

Non limitative examples of compound 1 which can be used to prepare the cation complex are titanium, zirconium, vanadium, hafnium Hf, lanthanium derivatives, etc., the titanium or Zr compounds are preferred. Examples which can be mentioned are: bis(eta 5 cyclopentadienyl) Zr diphenate; bis (eta 5 cyclopentadienyl) Zr 2,3,6-trimethylphenate, bis (eta 5 cyclopentadienyl) Hf diphenate, bis tetramethylcyclopentadienyl Zr diphenate, etc.

The catalysts of the present invention are obtained for example by direct reaction of biscyclopentadienyl metal dialkyl, preferably dimethyl, with the corresponding phenols.

This reaction gives substantially quantitative yields. The corresponding phenol can be used in excess since it can also act as a reaction solvent. Other solvents are for example cyclohexane, methylcyclohexane, hexane, diethylether, benzene, toluene, etc. This preparation method is illustrated as an example in the examples reported hereinafter.

The polymerization to obtain the invention $C_2$–$C_8$ copolymers and terpolymers $C_2$–$C_8$ and at least one alpha-olefin can be carried out in suspension, in solution, or in gas phase, at temperatures generally ranging from 0° C. to 150° C. at a pressure generally ranging from 1 to 300 bar, optionally employing a molecular weight regulator, for example hydrogen.

The invention catalysts are generally used in ethylene and alpha-olefin (co)polymerization processes.

This kind of catalysis is described for other kinds of metallocenes in the Patent Application WO 93/08221, incorporated herein by reference. The modifications of component 1), 2a) and 2b) indicated in said WO '221 can be applied also to the catalysts of the invention with the proviso that $L_2$ and $L_3$ have the meaning of the present invention. In this Patent there is a detailed description of all the various kinds of bonds which can be used.

As above said, the invention copolymers and terpolymers surprisingly show improved activities as CFPP additives with respect to the ethylene/propylene copolymers known in the art.

Moreover the ethylene/octene copolymers of the present invention are characterized by having the $X_2$ and/or $X_4$ inversions, as above defined, lower than 0.02.

Specifically, according to the present invention, the $C_2/C_8$ copolymers and the $C_2/C_3/C_8$ terpolymers are preferred. Preferably said polymers are obtained by using, as catalyst, component 1) in combination with component 2b).

The middle distillate physical characteristic measurements are carried out by determining the following parameters: Cloud Point (C.P.), Pour Point (P.P.) and Cold Filter Plugging Point (C.F.P.P.) as defined in the ASTM D2500-81; ASTM D97-66 and IP 309/83 methods, respectively.

The molecular weight determination (both number average Mn and weight average Mw) is carried out by Gel Permeation Chromatography (GPC) which gives also the molecular weight (MWD) distribution. See for example W. W. Yau et al "Modern Size Exclusion Liquid Chromatography", John Wiley and Sons, N.Y. 1979.

The intrinsic viscosity (dl/g) is measured according to known methods, for instance in tetraline at 135° C. The viscosimetric molecular weight Mv can also be determined by using methods well known in the intrinsic viscosity art. See for instance: L. H. Tung, "Fractionation of Synthetic Polymers" Ed. Marcel Dekkers Inc. N.Y. 1977, J. Polymer Sci 20, 495–506, 1956; G. Moraglio, Chim. Ind. (Milano) 10 984, 1959.

The preferred average molecular weights by number (Mn) are generally comprised in the range 300–50,000, preferably 800–25,000, more preferably 1,500–15,000.

The molecular weight distribution is generally in the range of 1.5–3.5, usually 1.5–2.5.

The A and B middle distillates free from additives used in the Examples, have the following characteristics:

| | type A | type B |
|---|---|---|
| density (IP 160) (15° C./gxcm$^{-3}$) | 0.8397 | 0.83 |
| I.B.P. (initial boiling point) | 170.2° C. | 164.8° C. |
| f.b.p. (final boiling point) | 355.2° C. | 357.1° C. |
| 90%–20% vol. | 101.4° C. | 117.3° C. |
| f.b.p. - 90% vol. | 21.1° C. | 30.0° C. |
| C.P. | −5.2° C. | −8.3° C. |
| C.F.P.P. | −8° C. | −9° C. |
| P.P. | −12° C. | −18° C. |

The methods for determining the invention polymers sequences distribution, in particular the $X_2$ and $X_4$ inversions are well known in the art and can be determined by $^{13}C$ NMR as described in U.S. Pat. No. 5,097,084 herein incorporated by reference.

The percentage of terminal unsaturations of ethylidenic type —$CR^{1t}$═$CH_2$, wherein $R^{1t}$ is an alkyl from 1 to 12 C atoms, or ethylenic type —CH═$CH_2$, can be determined, if desired, by IR (FTIR), or by titration or by $^{13}C$ NMR.

The invention terpolymers are polymers of ethylene, octene and at least one alpha-olefin from 3 to 12 carbon atoms. The preferred invention terpolymers are ethylene-propylene polymers with other alpha-oelfins, preferably octene.

As optional monomers containing more than one ethylenic unsaturation, conjugated dienes, for example butadiene, isoprene, piperylene, 1,3-hexadiene, 1,3-octadiene, 2,4-decadiene, cyclopentadiene; non conjugated dienes such as 1,4-hexadiene, 7-methyl-1,6-octadiene; cyclic non conjugated dienes such as norbornene, ethylidennorbornene, 4-vinylcyclohexene and vinylaromatic monomers such as styrene, 2,4-vinylstyrene, etc., can be mentioned.

The total amount of alpha-olefins in the invention polymers is generally in the range 5–50% by moles, preferably 5–40%, more preferably 5–35%.

The diolefin amount is in the range 0–20% by weight, preferably 1–15%.

As said, the $C_2$–$C_8$ copolymers or terpolymers of the invention can be combined with other cold flow improvers (CFI) known in the art to obtain synergistic effects as regards both CFPP and the filterability and the WAS effect. As known CFIS according to the present invention, ethylvinylacetates, fumarates, acrylates, propionates, are preferably used. Preferably in order to obtain a superior synergistic effect the invention polymers are combined with the above indicated CFIs and moreover also with a third CFI selected from nitrogen polar compounds.

The known CFI briefly described are the following:

$$-[C(D)(E)-CH(G)]_{m2}-[C(J)(K)-CH(L_0)]_{n2}-$$

wherein

D=$R_t$, $COOR_t$, $OCOR_t$, $R^2_tCOO_t$, or $OR_t$,

E=H, $CH_3$, D, or $R^2_t$,

G=H or D

J=H, $R^2_t$, $R^2_tCOOR_t$, or an aryl or heterocyclic group,

K=H, $COOR^2_t$, $OCOR^t_2$, or $OR^2_t$ or COOH,

L=H, $R^2_t$, $COOR^2_t$, $OCOR^2_t$, COOH, or aryl, $R_t \geqq C_{10}$ $R^2_t \geqq C_1$, and $m_2$ and $n_2$ represent the molar ratios, $m_2$ comprised between 1–0.4, and $n_2$ comprised between 0–0.6.

The known CFI polymers can contain also units deriving from other monomers. These polymers can be copolymers of maleic anhydride or maleic acid, or of fumaric acid and of another ethylenically unsaturated monomer, for instance an alpha-olefin or an unsaturated ester, for instance vinyl acetate. Molar ratios between comonomers in the range 2:1–1:2 can be used. Examples of olefins which can be copolymerized for example with maleic anhydride, comprise 1-decene, 1-dodecene, 1-tetradecene, 1-hexadecene and 1-octadecene. The copolymer can be esterified with any suitable technique and, although preferred, it is not essential that the maleic anhydride or the fumaric acid are esterified for at least 50%. Examples of alcohols which can be used comprise n-decan-1-ol, n-dodecan-1-ol, n-tetradecan-1-ol, n-hexadecan-1-ol, and n-octadecan-1-ol. The alcohols can also contain up to one methylic substituent for each chain, for example 1-methylpentadecan-1-ol, 2-methyltridecan-1-ol. The alcohol can be a mixture of normal and branched alcohols with a single methyl. Each alcohol can be used to esterify maleic anhydride copolymers with any olefin. It is preferred to use pure alcohols rather than the alcohol mixtures commercially available, but if mixtures are used, $R^2$ refers to the average number of carbon atoms in the alkyl group, if alcohols containing a branched group in the first or in the second position are used, $R^2$ refers to the branched segment of the alcohol linear chain. When mixtures are used, it is important that no more than 15% of the $R^2$ groups have the $R^2$+2 value. The alcohol selection clearly depend on the selection of the copolymerized olefin with maleic anhydride, so that $R+R^2$ is in the range 18–38. The preferred value of $R+R^2$ can depend on the fuel boiling characteristics wherein the additive is to be used. These polymers can be also fumarate polymers and copolymers for example as those described in the European Patent Applications 153,176 and 153,177. Other suitable polymers are the alpha-olefin polymers and copolymers and esterified styrene and maleic anhydride copolymers, and esterified styrene and fumaric acid copolymers. Other (co)polymers which can be used are ethylene-unsaturated monocarboxylic acid ester copolymers. The ester can be an unsaturated carboxylic acid ester with a saturated alcohol or, preferably, a saturated carboxylic acid ester with an unsaturated alcohol. Examples of the former are the methyl acrylate, ethyl acrylate, butyl acrylate, methyl methacrylate, ethyl methacrylate, butyl methacrylate, lauryl acrylate, isopropyl acrylate and isobutyl acrylate. Examples of the latter are the vinyl acetate, propionate, butyrate and isobutyrate. The preferred copolymer is an ethylene-vinyl acetate copolymer.

The copolymer advantageously contains from 10 to 50%, preferably advantageously at least 25% by weight of the ester. The number average molecular weight of the unsaturated ethylenic ester copolymer is advantageously at least 7,500, and more preferably in the range 850–4,000, preferably 1,250–3,500 and more preferably about 3,000 as measured by vapour phase osmometry. The linear polymers derived from alkylene, for example ethylene, oxides, for example polyethylenglycol esters, and amino derivatives thereof, can also be used.

The above mentioned third additive CFI, a nitrogen polar compound, which is preferable to use in combination with the above mentioned CFIs and the invention polymers, and generally the nitrogen polar compounds are generally aminic salts and/or amides formed by reaction of at least a molar part of a substituted hydrocarbide with an hydrocarbon acid molar part having from 1 to 4 groups of carboxylic acid and an anhydride thereof; esters/amides can also be used containing from 3 to 300, preferably from 50 to 150, total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof, but shorter chains can be used if the resulting nitrogen polar compound is soluble in oil; it will usually contain about 30 to 300 total carbon atoms. The nitrogen polar compound preferably contains at least an alkylic segment of $C_8$–$C_{24}$ linear chain.

Suitable amines comprise primary, secondary and tertiary amines, preferably secondary amines, or quaternary ammonium salts.

Examples of primary amines comprise tetradecyl amine, cocoamine, and hydrogenated tallow amine. Examples of secondary amines comprise dioctadecyl amine and methyl phenyl amine. Amine mixtures are also suitable and many amines derived from natural materials are mixtures. A preferred amine is a secondary hydrogenated tallow amine of formula $HNR_3R_4$ wherein $R_3$ and $R_4$ are alkylic groups derived from hydrogenated tallow fats composed of approximately 4% of $C_{14}$, 31% of $C_{16}$, 59% of $C_{18}$.

Examples of suitable carboxylic acids (and anhydrides thereof) to prepare these nitrogen compounds comprise cyclopentane- 1,2 dicarboxylic acid and naphthalendicarboxylic acids. Generally, these acids will have about 5–13 carbon atoms in the cyclic fraction. Preferred acids are benzen dicarboxylic acids such as phthalic acid, isophthalic acid and terephthalic acid. The phthalic acid or its anhydride is particularly preferred. The particularly preferred compound is the amido-amine salt formed by reacting a molar part of phthalic anhydride with two molar parts of dihydrogenated tallow amine. Another preferred compound is the diamide formed by the dehydration of this amide-amine salt. In addition, the known CFI formulations can optionally comprise other additives of fuel oils, many of them are used in the art or are known in the prior art.

The additive amount of the present invention, singly or in combination with the other above mentioned CFIs, to be used in the middle distillates, ranges from 10–5,000 ppm, preferaly 50–900 ppm, more preferably 100–500 ppm, still more preferably 100–200 ppm. The ratios by weight among the invention copolymer, the known CFI (for example EVA, fumarates, propionates, acrylates) and the nitrogen polar compound are the following: 10/1:10/1:10, preferably 10/1:5/1:5.

The following experimental Examples are reported for better illustrating the invention.

EXAMPLE 1

Zirconocene Bisphenoxide Synthesis (Catalyst)

In a flask containing 50 ml of toluene, 1.988 millimoles of dimethyl zirconocene were dissolved. Successively under stirring 3.976 millimoles of phenol were added. The solution develops methane according to the reaction:

$$Cp_2Zr(CH_3)_2+2CH_6OH \rightarrow [C_6H_5O]_2ZrCp_2+2CH_4\uparrow$$

The process was carried out at room temperature and is quantitative. Yields about 100%. After about 4 hours of stirring, the solution was dried and the solid was characterized by $^1H$ NMR: the spectrum shows the Cp peak and all the series of the two phenyls hydrogen peaks.

$Cp_2Zr(O—C_6H_5)_2$: $^1H\delta$=5.94 (s,10H, Cp), 6.75–7.29 (m, 10H, $C_6H_5$).

EXAMPLE 2

Preparation of the Compound 2b)

N,N Dimethylanilinium Tetra(Perfluorophenyl) Borate ($BNF_4$) Synthesis

This compound was synthetized according to the following art:

J. A. Ewen, M. J. Elder, R. L. Jones, L. Haspeslagh, J. L. Atwood, S. G. Bott, K. Robinson, Macromol. Chem., Macromol. Symp. 48/49, 253 (1991).

In a 100 ml flask, 1.98 g (2.88 millimoles) of lithium tetra(perfluorophenyl)borate dissolved in 20 ml of methylene chloride are introduced. To this solution 1.05 g (6.66 millimoles) of N,N-dimethylaniline chlorohydrate dissolved in 10 ml of methylene chloride are added. The lithium chloride precipitates, it is filtered and the solution is dried. A white paste is formed which is washed more times in pentane until a white solid is obtained. The yield is about 71%.

EXAMPLE 3 (COMPARATIVE)

Polymerization Carried out with the Catalyst of Example 1

The reactor used is an AISI 316 steel autoclave (5 liter volume) equipped with an anchor stirrer and able to operate at ≦150 bar pressure.

The autoclave is equipped with 4 feeding inlets, an outlet and a water circulating cooling system.

The reactor is purified more times with anhydrous, hot nitrogen and kept under pressure at 120° C. for 24 hours.

From the purification temperature the autoclave is cooled at 25° C. by maintaining the nitrogen pressure at 1 bar. 250 ml of distilled toluene together with 0.7 ml of triethylaluminum and, under stirring, 230 g of liquid propylene, are introduced in sequence.

It is heated to 80° C. and, when this temperature is reached, 5 ethylene bar are added. A 20 Mg of $Cp_2Zr$ (bisphenoxide) solution of Example 1 and 39.3 mg of the co-catalyst of Example 2 in 50 ml of toluene are added under an anhydrous nitrogen overpressure.

The polymerization is carried out for 6 minutes by keeping the pressure constant by continuous ethylene feeding.

The polymerization is quickly stopped by venting and cooling the autoclave to 25° C.

The produced polymer is precipitated using ethanol/acetone acidified with hydrochloric acid, washed more times with ethanol/acetone and anhydrified under vacuum.

102 g of polymer containing 32% by weight of propylene (24% by moles) determined by IR, are obtained. The viscosimetric molecular weight Mv is 12,000.

EXAMPLE 4 (COMPARATIVE)

CFPP Determination

The polymer of Example 3 was used as CFPP additive for the A and B middle distillates having the above mentioned features. The CFPP value was determined by using 150 ppm of polymer.

The results are:

Middle distillate CFPP (° C.)

A −15

B −17

EXAMPLE 5

Polynmerization Carried out with the Catalyst of Example 1 Ethylene/Octene Copolymer Example 3 was repeated but with the following variations: 100 g of octene were used instead of propylene.

80 g of copolymer containing 24% by weight of octene (corresponding to 7.5% by moles) determined by $^{13}C$ NMR, were obtained.

The viscosimetric molecular weight Mv is 13,800.

EXAMPLE 6

CFPP Detrmination

The polymer of Example 5 was used as CFPP additive for the A and B middle distillates having the above mentioned features. The CFPP value was determined by using 150 ppm of polymer.

The results are:

Middle distillate CFPP (° C.)

A −16

B −20

EXAMPLE 7

Polymerization Carried out with the Catalyst of Example 1 Ethylene/Propylene/Octene Terpolymer Example 3 was repeated but with the following variations:

50 g of octene together with propylene, in amount of 50 g, were also added;

the polymerization temperature was of 70° C. (instead of 80° C.);

15 mg of $Cp_2Zr$(bisphenoxide) solution of Example 1 and 29.5 mg of the catalyst of Example 2 in 50 ml of toluene were added under an anhydrous nitrogen overpressure.

The polymerization is carried out for 5 minutes by keeping the pressure constant by continuous ethylene feeding.

70 g of polymer containing 16.2t by weight of propylene (12% by moles) and 11% by weight of octene (3.2% by moles) determined by $^{13}C$ NMR, were obtained. The viscosimetric molecular weight Mv is 13,500.

EXAMPLE 8

CFPP Determination

The polymer of Example 7 was used as CFPP additive for the A and B middle distillates having the above mentioned features.

The CFPP value was determined by using 150 ppm of polymer.

The results are:

Middle distillate CFPP (° C.)

A −17

B −21

EXAMPLE 9

Polymerization Carried out with the Catalyst of Example 1 Ethylene/Propylene/Octene Terpolymer Example 7 was repeated but with the following variations: propylene in amount of 75 g, octene 75 g;

the polymerization temperature was of 60° C. (instead of 70° C.);

The polymerization is carried out for 4 minutes by keeping the pressure constant by continuous ethylene feeding 60 g of polymer containing 19.7% by weight of propylene (17% by moles) and 22.4% by weight of octene (7.3% by moles) determined by $^{13}C$ NMR, were obtained.

The viscosimetric molecular weight Mv is 21,300.

EXAMPLE 10

CFPP Determination

The polymer of Example 9 was used as CFPP additive for the A and B middle distillates having the above mentioned features.

The CFPP value was determined by using 150 ppm of polymer.

The results are:

Middle distillate CFPP (° C.)

A −18

B −23.

What is claimed is:

1. A method for improving cold properties of middle distillates, comprising mixing said middle distillates with ethylene-octene co-polymers and terpolymers comprising ethylene, octene with at least an alpha-olefin of from 3 to 12 carbon atoms, and optionally, comonomers containing more than one ethylenic unsaturation, wherein the ethylene-octene co-polymers and terpolymers are obtainable by polymerization of monomers in the presence of catalysts comprising:

1) a bis-cyclopentadienyl derivative having the general formula:

$$(Cp_1Cp_2)—M—(L_2L_3)$$

containing groups with oxygen bound to the transition metal, wherein

M is a metal from the IIIb group to the Vb group or of the lanthanide series of the Periodic Table of the Elements;

$Cp_1$ and $Cp_2$, equal to or different from each other, represent the following groups bound to M with delocalized π bonds, wherein the groups are selected from cyclopentadiene, indene, fluorene, or derivatives thereof substituted in the case of indene and fluorene also with the hydrogenated phenil ring (rings) and with substituents both in the phenilic and cyclopentadienylic rings, also with heteroatoms; or with π bonds in the case of cyclooctatriene; or said $Cp_1Cp_2$ groups constrained with M by a bivalent linking bridge, —R— type, wherein R is an alkylene from 1 to 4 carbon atoms, —Si(R')2— wherein R' is an alkyl from 1 to 10 C atoms; or an aryl optionally containing heteroatoms, or an alkylaryl or an arylalkyl from 7 to 20 carbon atoms;

$L_2$ and $L_3$, equal to or different from each other represent an $OR_a$ group wherein $R_a$ is an aryl group, optionally the ring carbon atoms being substituted by heteroatoms, and optionally containing substituents of alkyl type from 1 to 10 carbon atoms, and 2) a co-catalyst comprising a compound of formula:

$$(L_1—H)^+(A)^-$$

wherein $(A)^-$ is $(B\ Q_q)^-$, wherein $L_1$ is a neutral Lewis base;

$(L_1—H)^+$ is a Bronsted acid;

B is boron with valence 3;

Q, equal to or different from each other, are selected from the following group consisting of hydrides, halides, alkyls, aryls optionally substituted, with halogens, alkoxides, aryioxides, dialkylamido, or $R_0COO$— wherein $R_0$ has from 1 to 20 carbon atoms, with the proviso that Q can be equal to halide only once; and q is an integer equal to the valence of B plus 1.

2. The method according to claim 1, comprising combining the middle distillates with cold flow improvers (CFI).

3. The method according to claim 2, wherein the CFI are selected from the group consisting of ethyl-vinylacetates, fumarates, acrylates, and propionates.

4. The method according to claim 3, wherein the CFI is a nitrogen polar compound.

5. The method according to claim 4, wherein the ratios by weight among the co-polymer, the CFI and the nitrogen polar compound is 10/1:10/1:10.

6. The method according to claim 1, wherein the molar ratio between the co-catalyst of 2) and the metal of the catalyst of 1) is in a range (0.1–4):1.

7. The method according to claims 1, wherein the co-catalyst of 2) is a substituted ammonium trialkyl borate salt selected from the group consisting of triethylammonium tetraphenylborate, tripropylammonium tetraphenylborate, tris(n-butyl) ammonium tetraphenylborate, trimethylammonium tetrakis(p-tolyl)borate, tributylammonium tetrakis (pentafluorophenyl)borate, tripropylammonium tetrakis (2,4-dimethyphenyl) borate, tributylammonium tetrakis(3, 5dimethylphenyl)-borate, and triethylammonium tetrakis (3,5ditrifluoromethylphenyl)borate.

8. The method according to claim 1, wherein the catalyst of 1) is selected from the group consisting of a hafnium, a chromium, and a lanthanum derivative.

9. The method according to claim 1, wherein the co-catalyst of 1 ) is a titanium or a Zr derivative.

10. The method according to claim 1, wherein the catalyst of 1) is selected from the group consisting of bis (eta 5 cyclopentadienyl) Zr diphenate; bis (eta 5 cyclopentadienyl) Zr 2,3,6-trimethylphenate, bis (eta 5 cyclopentadienyl) Hf diphenate, and bis tetramethylcyclopentadienyl Zr diphenate.

11. The method according to claim 1, wherein the ethylene-octene copolymers comprise $X_2$ and/or $X_4$ inversions lower than 0.02.

12. The method according to claim 1, wherein said terpolymers are ethylene polymers with propylene and octene.

13. The method according to claim 1, wherein the monomers containing more than one ethylenic unsaturation are selected from the group consisting of dienes such as butadiene, isoprene, piperylene, 1,3-hexadiene, 1,3-octadiene, 2,4-decadiene, cyclopentadiene; non conjugated dienes such as 1,4-hexadiene, 7-methyl-1,6octadiene; or cyclic non conjugated dienes such as norbornene, ethylidennorbornene, 4-vinylcyclohexene and vinylaromatic monomers.

14. The method according to claim 13, comprising the alpha-olefins in a range of 5–50% moles.

* * * * *